US009812113B2

(12) United States Patent
Hera

(10) Patent No.: US 9,812,113 B2
(45) Date of Patent: Nov. 7, 2017

(54) VEHICLE ENGINE HARMONIC SOUND CONTROL

(71) Applicant: Bose Corporation, Framingham, MA (US)

(72) Inventor: Cristian M. Hera, Lancaster, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/667,164

(22) Filed: Mar. 24, 2015

(65) Prior Publication Data

US 2016/0284334 A1 Sep. 29, 2016

(51) Int. Cl.
*G10K 11/16* (2006.01)
*G10K 11/178* (2006.01)

(52) U.S. Cl.
CPC .... *G10K 11/178* (2013.01); *G10K 2210/1282* (2013.01)

(58) Field of Classification Search
CPC ..... G10K 2210/1282; G10K 15/00; G10K 15/02; G10K 11/175; G10K 11/178
USPC ..... 381/56, 58, 71.1, 71.4, 86, 389
See application file for complete search history.

(56) References Cited

U.S. PATENT DOCUMENTS 8,270,628 B2 9/2012 Evert et al.
8,320,581 B2 11/2012 Hera et al.
2006/0269078 A1* 11/2006 Sakamoto ..... G10K 11/178 381/71.1
2012/0101611 A1* 4/2012 Inoue ..... G10K 15/02 700/94
2013/0156213 A1 6/2013 Pan et al.
2013/0260692 A1 10/2013 Hera
2014/0016792 A1* 1/2014 Christoph ..... G10L 19/06 381/61
2014/0205110 A1 7/2014 Hera
2014/0228078 A1 8/2014 Weber
2014/0277930 A1 9/2014 Pan et al.
2014/0294189 A1 10/2014 Pan
2015/0172807 A1* 6/2015 Olsson ..... G10K 11/175 381/74

OTHER PUBLICATIONS

The International Search Report and the Written Opinion of the International Searching Authority issued on Jun. 17, 2016 for corresponding PCT Application No. PCT/US2016/023600.

* cited by examiner

*Primary Examiner* — William A Jerez Lora
(74) *Attorney, Agent, or Firm* — Brian M. Dingman; Dingman IP Law, PC

(57) ABSTRACT

A method that is accomplished in a vehicle engine harmonic modification system. A non-zero target engine harmonic signal that is representative of a target engine harmonic sound level in the vehicle cabin is provided. The target engine harmonic signal is used in an operation of the engine harmonic modification system so as to modify the level of engine harmonic sound in the vehicle cabin, to bring the engine harmonic sound level in the vehicle cabin closer to the target engine harmonic sound level.

12 Claims, 8 Drawing Sheets

VEHICLE ENGINE HARMONIC SOUND CONTROL

BACKGROUND

This disclosure relates to control of engine harmonic sounds in a vehicle.

Engine harmonic sound levels in the cabin of a motor vehicle can be canceled or enhanced. Cancellation is aimed to reduce certain harmonics to zero. Enhancement bolsters certain harmonics so as to create a desired engine sound. In some cases, however, engines can operate such that at times the harmonics should be increased and at other times the harmonics should be decreased. One example is a displacement on demand (DoD) engine where not all of the cylinders are fired at all times. The harmonic sounds from DoD engines can change, in some cases dramatically, as the active cylinder configuration changes. This can detract from the experience of people in the vehicle.

SUMMARY

All examples and features mentioned below can be combined in any technically possible way.

In one aspect, a method that is accomplished in a vehicle engine harmonic modification system includes a non-zero target engine harmonic signal that is representative of a target engine harmonic sound level in the vehicle cabin is provided. The target engine harmonic signal is used in an operation of the engine harmonic modification system so as to modify the level of engine harmonic sound in the vehicle cabin, to bring the engine harmonic sound level in the vehicle cabin closer to the target engine harmonic sound level.

Embodiments may include one of the following features, or any combination thereof. The vehicle engine harmonic modification system may comprise an engine harmonic cancellation (EHC) system that reduces engine harmonic sound levels in the vehicle cabin. The vehicle engine harmonic modification system may alternatively or additionally comprise an engine harmonic enhancement (EHE) system that increases engine harmonic sound levels in the vehicle cabin.

The target engine harmonic signal may comprise both magnitude and phase targets. The magnitude and phase targets may be saved in lookup tables with table entries for the magnitude targets and the phase targets. The method may further comprise interpolating between lookup table entries to determine magnitude and phase targets that are not in the lookup tables.

The EHE system may be input with engine rotation speed, in which case the target harmonic signal may be generated by the EHE system. Whether the engine harmonic sound is reduced or increased may be dependent at least in part on engine RPM. The EHC system may reduce engine harmonics below a particular engine RPM and the EHE system may increase engine harmonics above the particular engine RPM.

The EHE system may generate harmonics that are in phase with the cabin engine harmonic sounds. The vehicle engine harmonic modification system may comprise a microphone that senses engine harmonic sounds in the vehicle cabin, in which case the target engine harmonic signal may be based on the level of engine harmonic sounds sensed in the vehicle cabin. Multiple loudspeakers may be used to modify the level of engine harmonic sound in the vehicle cabin, and the engine harmonic modification system may be arranged to select how much each speaker contributes to the modified engine harmonic sound level.

In another aspect, a method that is accomplished in a vehicle engine harmonic modification system that comprises an engine harmonic cancellation (EHC) system that reduces engine harmonic sound levels in the vehicle cabin and an engine harmonic enhancement (EHE) system that increases engine harmonic sound levels in the vehicle cabin, comprises providing a non-zero target engine harmonic signal that is representative of a target engine harmonic sound level in the vehicle cabin and that comprises both magnitude and phase targets, and using the target engine harmonic signal in an operation of the engine harmonic modification system so as to variably with engine RPM increase and reduce the level of engine harmonic sound in the vehicle cabin, to bring the engine harmonic sound level in the vehicle cabin closer to the target engine harmonic sound level, wherein whether the engine harmonic sound is reduced or increased is dependent at least in part on engine RPM.

Embodiments may include one of the following features, or any combination thereof. The magnitude and phase targets can be saved in lookup tables with table entries for the magnitude targets and the phase targets. The method may further comprise interpolating between lookup table entries to determine magnitude and phase targets that are not in the lookup tables. The EHE system may be input with engine rotation speed and the target harmonic signal may be generated by the EHE system. The EHE system may generate harmonics that are in phase with the cabin engine harmonic sounds.

In another aspect a method for producing a target engine sound in a vehicle cabin includes using an engine harmonic enhancement (EHE) algorithm to produce a harmonic target representative of a target engine sound based on a measured engine RPM, using an audio system to create an approximation of the harmonic target, based on the measured engine speed, at a microphone location in the vehicle cabin, and using an adaptive algorithm to drive the audio system to minimize/reduce a difference between the harmonic target and the approximation of the harmonic target measured at the microphone location. This method may further comprise maintaining the target engine sound at the microphone location while transitioning between engine modes.

In another aspect an engine sound management system for a vehicle includes circuitry for generating a harmonic target representative of a target engine sound based on a measured engine RPM, a microphone for measuring sound in a vehicle cabin, an output transducer for producing an approximation of the target engine sound at a location of the microphone, and circuitry for driving the output transducer to minimize a difference between the harmonic target and the approximation of the target engine sound. The circuitry for driving the output transducer may comprise an adaptive filter. The circuitry for producing the harmonic target may comprise one or more look-up tables that map the measured engine speed to magnitude and phase values for the harmonic target.

DETAILED DESCRIPTION

Figure 1:
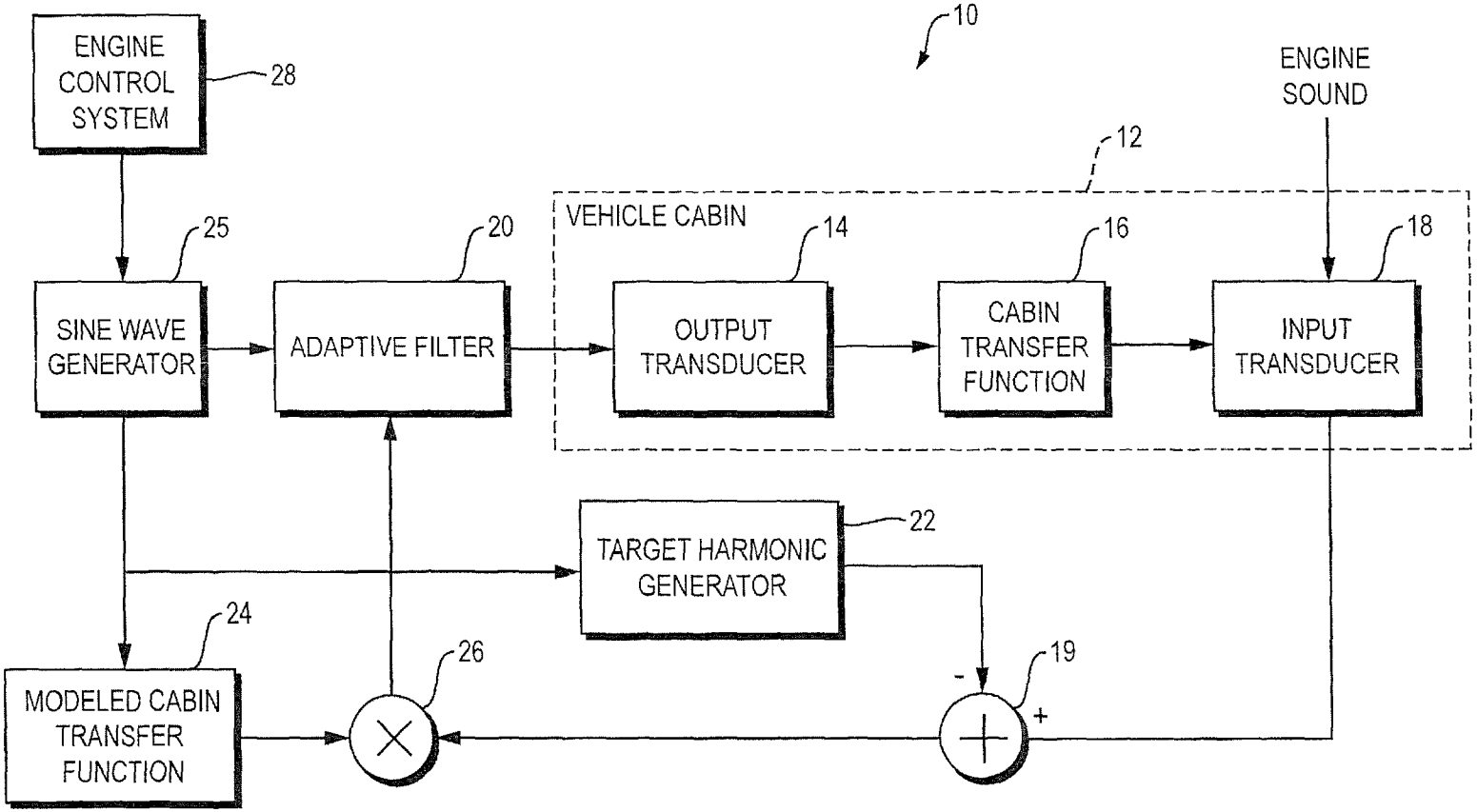
FIG. 1 is schematic block diagram of a vehicle engine sound control system that can also be used to practice the engine harmonic sound control methods of this disclosure.

This disclosure may be accomplished with a vehicle engine harmonic modification system that includes a non-zero target engine harmonic signal that is representative of a target engine harmonic sound level in the vehicle cabin. The target harmonic level can be established to achieve a desire aural objective. For example, the harmonics of displacement on demand (DoD) engines can change abruptly, which some users may find objectionable. Also these sounds can disrupt ongoing discussions or telephone calls. It is sometimes desirable to modify the engine harmonics to achieve a desired engine harmonic aural output in the cabin, which is done by operating the system so as to drive the harmonics to the target. More generally, the target engine harmonic signal is used in the engine harmonic modification system such that the level of engine harmonic sound in the vehicle cabin is modified so as to bring the engine harmonic sound level closer to the target engine harmonic sound level.

Engine harmonic enhancement (EHE) and engine harmonic cancellation (EHC) systems are known. EHE and EHC systems are disclosed in U.S. Pat. No. 8,320,581 and U.S. Patent Publications 2013/0260692 A1, 2014/0277930 A1 and 2014/0294189 A1; the disclosures of all of these prior U.S. patent and publications are incorporated by reference herein in their entireties.

EHC systems typically perform cancellation by driving the cabin microphone error signal to zero. EHE systems create harmonic signals that augment or enhance the natural engine harmonic sounds in the cabin. In the present vehicle engine harmonic sound control scheme, a non-zero target harmonic signal is generated, typically driven by the engine RPM. This signal is subtracted from the cabin microphone output error signal in the electronic domain, to create a target error signal. The system drives this target error signal to zero and thereby converges the cabin harmonic sounds to the target harmonic signal.

Elements of figures are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

FIG. 1 is a simplified schematic block diagram of an adaptive engine harmonic sound control system 10 that illustrates one example of the disclosed innovation. In this non-limiting example system 10 is designed to modify (e.g., cancel and/or enhance) engine harmonic sound in the cabin 12 of a motor vehicle. However, system 10 can be used to modify harmonic sound emanating from sources other than the engine, e.g., the drive shaft or other rotating or oscillating devices or volumes such as motors or the tire cavities. System 10 can also be used to modify harmonic sound in locations other than motor vehicles and in volumes other than motor vehicle cabins. As one non-limiting example, system 10 could be used to modify engine harmonics in the vehicle's muffler assembly.

System 10 uses adaptive filter 20 that supplies signals to one or more output transducers 14 that have their outputs directed into vehicle cabin 12. The output of the transducers, as modified by the cabin transfer function 16, is picked up by one or more input transducers (e.g., microphone) 18. Engine sounds in the vehicle cabin are also picked up by input transducer 18. Existing vehicle engine control system 28 supplies one or more input signals that are related to the vehicle engine operation. Examples include RPM, torque, accelerator pedal position, and manifold absolute pressure (MAP). A sine wave generator 25 is input with the signal(s) from engine control system 28 that relate to vehicle engine operation, and from which frequencies of the engine harmonic(s) to be modified can be determined. When the system is used to modify harmonic sound from oscillating or rotating devices other than the engine, sine wave generator 25 is input with a harmonic frequency to be cancelled that is derived from or computed based on operation of the oscillating or rotating device.

Sine wave generator 25 provides to adaptive filter 20 a harmonic sound modification reference signal that is also provided to modeled cabin transfer function 24 to produce a revised reference signal. The revised reference signal and the microphone output signal (after it is combined with the signal from target harmonic generator 22, described below) are multiplied together 26, and provided as an input to adaptive filter 20 to direct its adaptation. In this non-limiting example the adaptive algorithm is a filtered-x adaptive algorithm. However, this is not a limitation of the innovation as other adaptive algorithms could be used, as would be apparent to those skilled in the technical field. The operation of adaptive harmonic sound cancellation and enhancements systems is well understood by those skilled in the technical field.

Target harmonic generator 22 is input with the signal from sine wave generator 25 and engine control system 28. Target harmonic generator 22 will modify the magnitude and phase of the sine wave presented at its input based on predefined magnitude and phase values, as is known in the art. These values are chosen to create the desired engine sound characteristics, such as, but limited to, tonality, roughness, smoothness, loudness. The predefined magnitude and phase values are defined as a function of RPM. The created sine wave will be further adjusted in magnitude and possibly phase in accordance with the engine load (torque, manifold absolute level, or other similar indicators), gear position, accelerator pedal position, vehicle speed, before being applied to the control algorithm.

The target harmonic signal outputted from target harmonic generator 22 is subtracted from the microphone error signal to create a target error signal. System 10 drives this target error signal to zero, and thereby converges the cabin harmonic sounds to the target. System 10 thus adaptively adjusts the sound played by the speakers, to match the chosen target at the microphone location. The desired target sound is also maintained while a DoD engine transitions between engine modes.

The adaptive algorithm parameters, such as step size and leakage factor, can be adjusted to induce a variation, or jitter, in the error signal, and thus in the transducer output. This jitter creates a more natural engine sound as it enriches the pure sine waves. The step size and leakage adjustment is constrained by the need to converge and stability of the adaptive algorithm. The range in that these parameters can be adjusted will be different for different frequencies or RPM values. Known methods can be used to control the step size.

Figure 2:
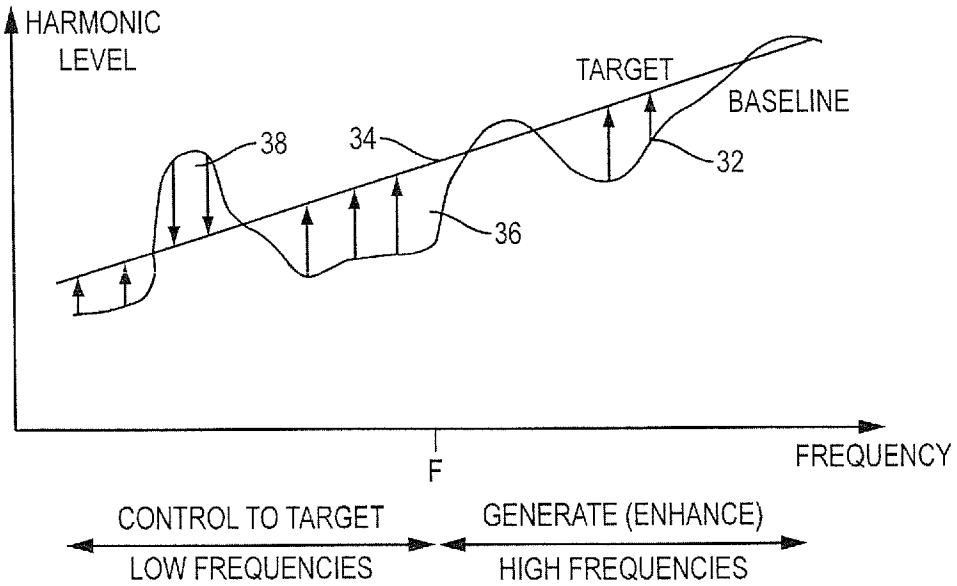
FIG. 2 is a plot of vehicle cabin engine harmonic levels and an exemplary target engine harmonic level signal.

FIG. 2 conceptually illustrates an operation of the adaptive engine harmonic sound control system 10. Actual cabin harmonic level 32 and target harmonic level 34 are illustrated. System 10 is arranged to modify actual harmonics 32 to bring them to (or closer to) target 34. Thus, for example, in area 36 in which the actual harmonic level is below the target, system 10 enhances the harmonics as indicated by the arrows, while in area 38 in which the actual harmonic level is above the target, system 10 cancels the harmonics as indicated by the arrows.

Harmonic cancellation has an inherent limitation of how high in frequency it can operate. This limitation depends on the system layout, the number of speakers, the number of microphones and the zone wherein cancellation is desired. The greater the volume of the cancellation zone, the lower the maximum frequency (i.e., the higher the minimum wavelength) in which sound can be cancelled. This is conceptually illustrated in FIG. 2 where above frequency F (which in one non-limiting example is about 200 Hz) system 10 no longer cancels harmonics, as indicated by area 40 that is above frequency F and wherein no cancellation occurs. Further, EHE typically does not take into account the phase of the baseline harmonic because EHE is typically designed to operate on higher frequencies where phase cannot be controlled over a large enough space. The generated enhancement at these higher frequencies is usually much higher in level than the baseline engine harmonic, and therefore the phase is less important. For low frequencies, typical EHE systems will generate a harmonic, but it may be out of phase with the baseline and thus, if the level is comparable to that of the baseline engine harmonics, cancel it rather than enhance it. The closed loop algorithm of system 10 resolves this problem by modifying the harmonics (cancelling and enhancing as necessary) to a target.

Figure 3:
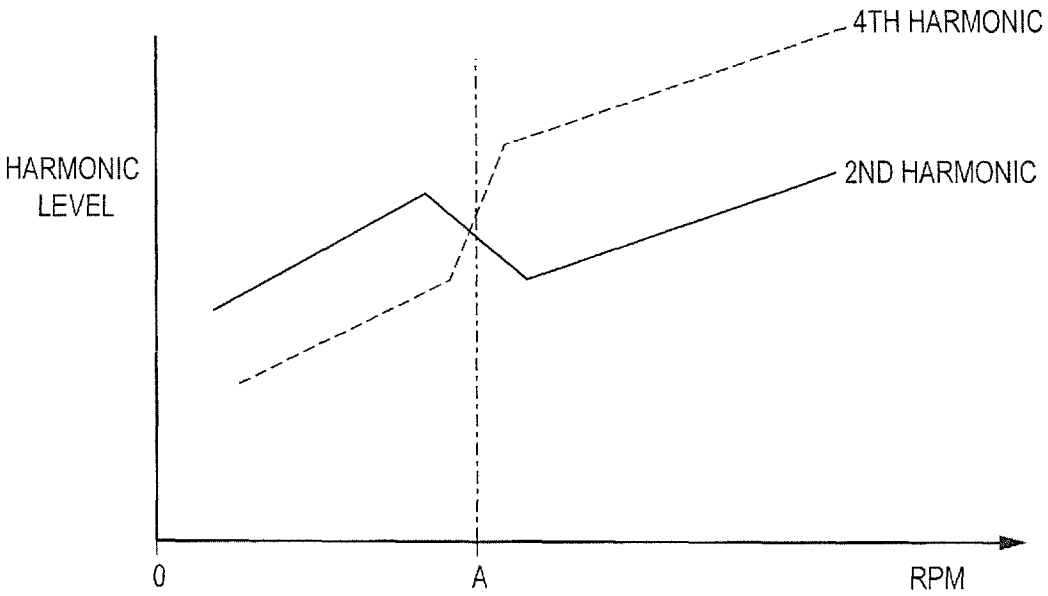
FIG. 3 is a plot of the second and fourth harmonics of a displacement on demand engine.

FIG. 3 conceptually illustrates the 2d and $4^{th}$ harmonics of an 8 cylinder DoD engine. At RPM "A" the dominant sound switches from the 2d harmonic to the $4^{th}$ harmonic. This can be disconcerting or disruptive to a person sitting in the cabin. The present harmonic sound control scheme can be used to smooth the harmonics to present a more typical or expected sound, or one that is less disruptive. One possible non-limiting target harmonic level would raise the $4^{th}$ harmonic curve below RPM "A" so that both below and above this RPM the $4^{th}$ harmonic would be dominant, and it would increase with RPM gradually and essentially continuously, as might be expected from a non-DoD 8 cylinder engine.

Figure 4A:
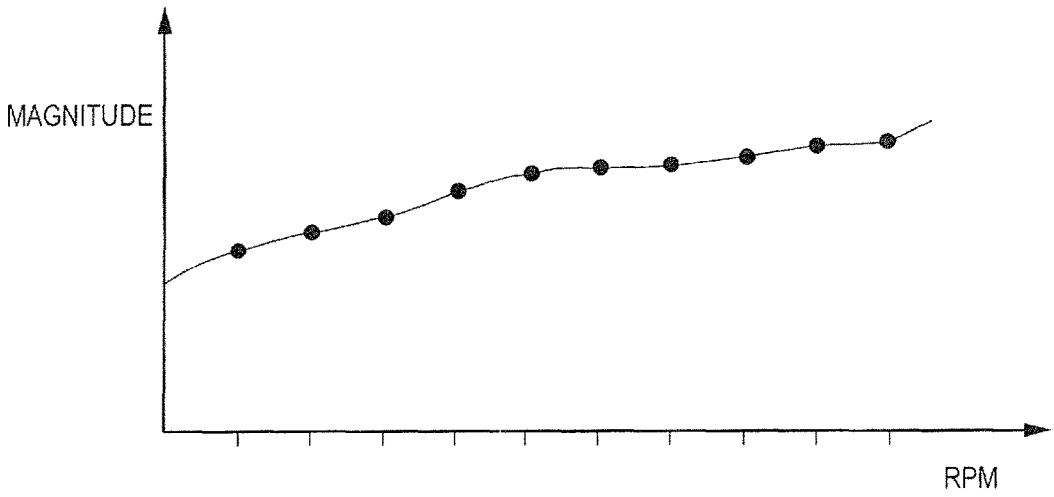
FIGS. 4A and 4B illustrate the magnitude and phase of an exemplary target engine harmonic signal.
Figure 4B:
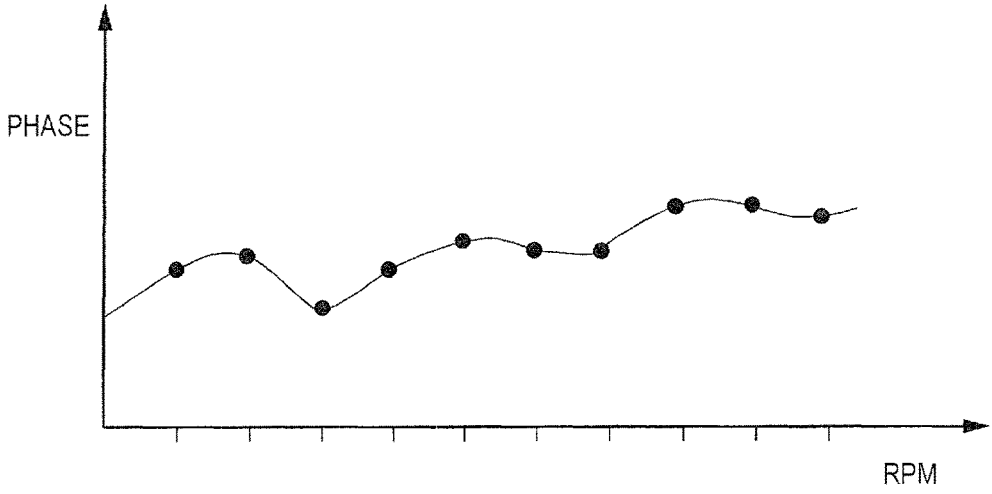

In an exemplary, non-limiting vehicle engine harmonic sound control aspect, one or more target harmonics are predetermined and stored in computer memory. Both magnitude and phase vs. RPM can be stored. An exemplary magnitude and phase vs. RPM target is shown in FIGS. 4A and 4B. One manner in which these data can be saved is to store the target levels in a lookup table (LUT). A LUT could, for example, save the magnitudes and phases at a series of RPMs, as indicated by the ten large circles in each of FIGS. 4A and 4B. The system can retrieve these data for use in developing the target harmonics that are subtracted from the error microphone signal in the electronic domain to create the harmonic error signal that is driven to zero. For levels that are between LUT entries, the magnitude and phase can be interpolated. Other manners of saving, accessing and estimating the harmonic targets would be apparent to those skilled in the field and are included within the scope of the present invention.

FIGS. 5-8 schematically illustrate four additional configurations of the subject engine harmonic sound control system. They describe the case of multiple harmonics control between one speaker and one microphone, the case of one harmonic between multiple speakers and one microphone, the case of one harmonic between one speaker and multiple microphones, and the case of one harmonic between multiple speakers and multiple microphones, respectively. A combination of these four configurations would result in a multi-harmonic multiple input-multiple output system. In FIGS. 5-8 the variable $h_{TGT_X}(t)$ is used to represent the target harmonics.

Figure 5:
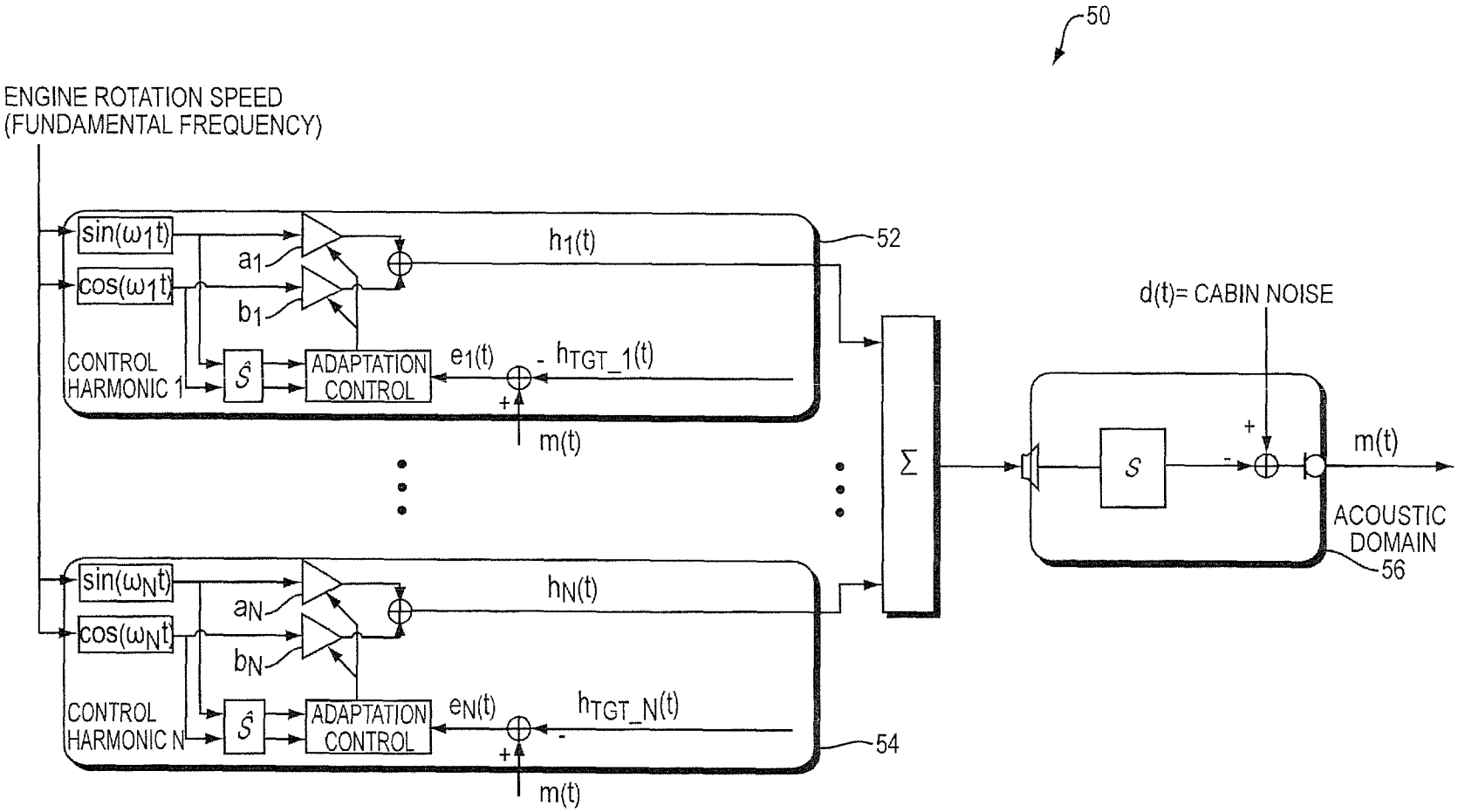
FIGS. 5-8 schematically illustrate four additional configurations of the subject engine harmonic sound control system. The figures describe: the case of multiple harmonics between one speaker and one microphone; the case of one harmonic between multiple speakers and one microphone; the case of one harmonic between one speaker and multiple microphones; and the case of one harmonic between multiple speakers and multiple microphones, respectively.

FIG. 5 illustrates system 50 that comprises elements 52 and 54 in the electronic domain that each accomplish the functions of the sine wave generator, the adaptive filter, the target harmonic generator and the modeled cabin transfer function of FIG. 1, but for different harmonics (1 and N, respectively). The figure depicts just elements 52 and 54, for harmonics 1 and N, out of a greater number of harmonics. Acoustic domain elements 56 include the transducer, microphone and cabin transfer function S.

Figure 6:
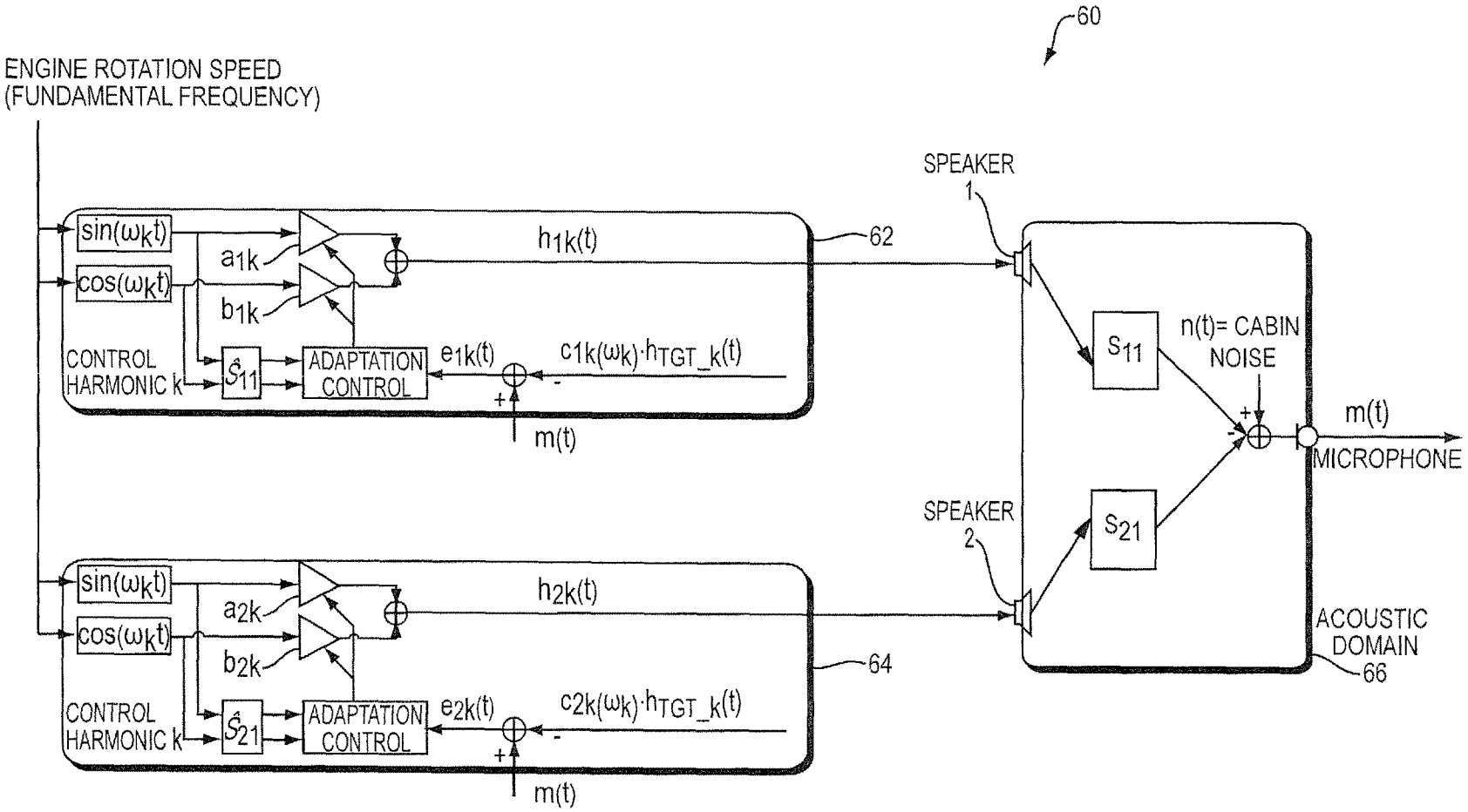

FIG. 6 illustrates a system 60 with two speakers and one microphone, and a single harmonic k. As with FIG. 5, elements 62 and 64 accomplish the functions in the electronic domain, while element 66 accomplishes the functions in the acoustic domain and includes cabin transfer functions $S_{11}$ and $S_{21}$. The target harmonic at the microphone location is created by playing signals out of both speakers. As the adaptive filters converge to minimize the error signals, the sum of the signals played out of the two speakers and the engine harmonic will add up to the target harmonic. The coefficients $c_{1k}$ and $c_{2k}$ are used to select by how much each of the speakers will contribute to construct the target harmonic. The coefficients are defined as function of RPM. This means that the system can select how much each speaker contributes at any given RPM.

Figure 7:
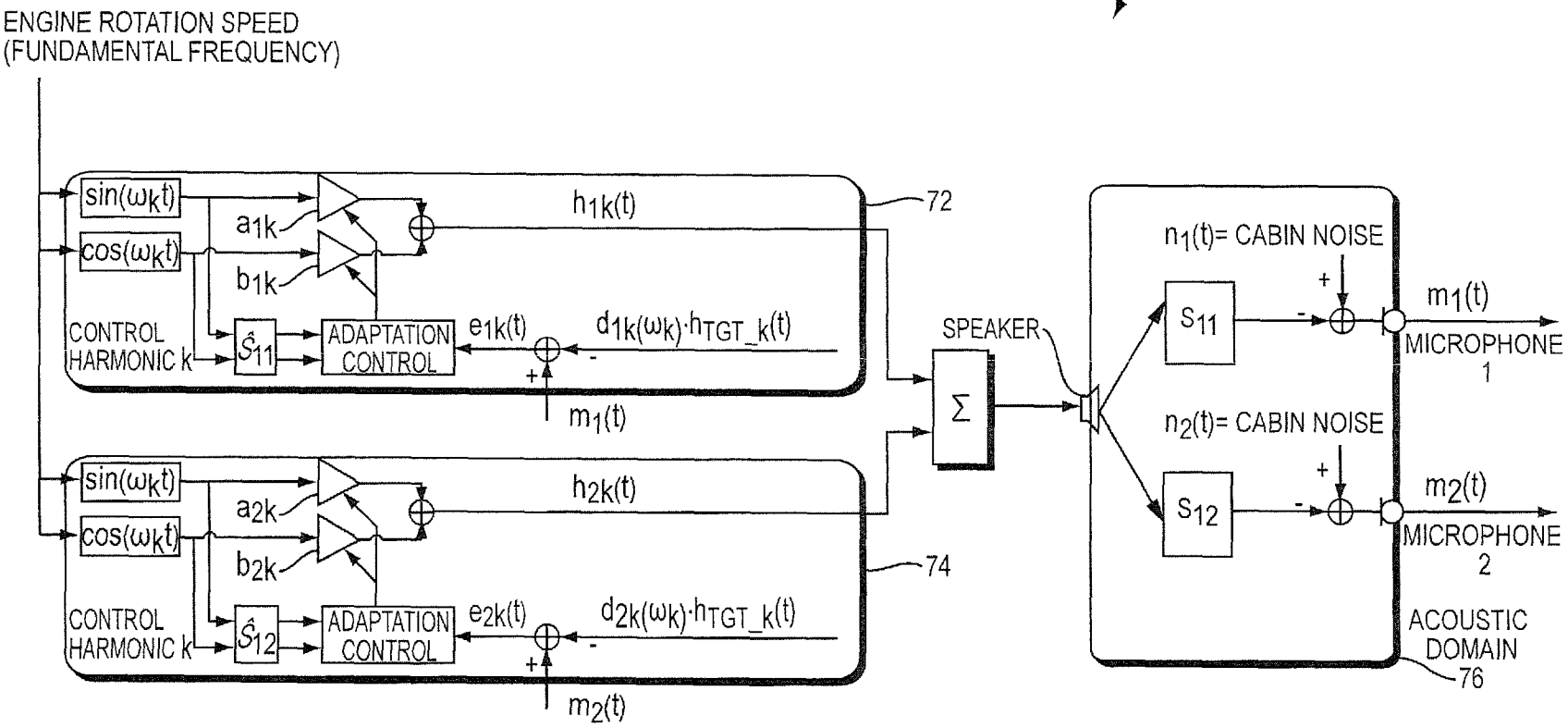

A similar approach is taken for the case of a system using a single speaker and multiple microphones as illustrated in FIG. 7. In system 70, elements 72 and 74 accomplish the functions in the electronic domain (at a single harmonic k), while element 76 accomplishes the functions in the acoustic domain and includes cabin transfer functions $S_{11}$ and $S_{12}$.

Figure 8:
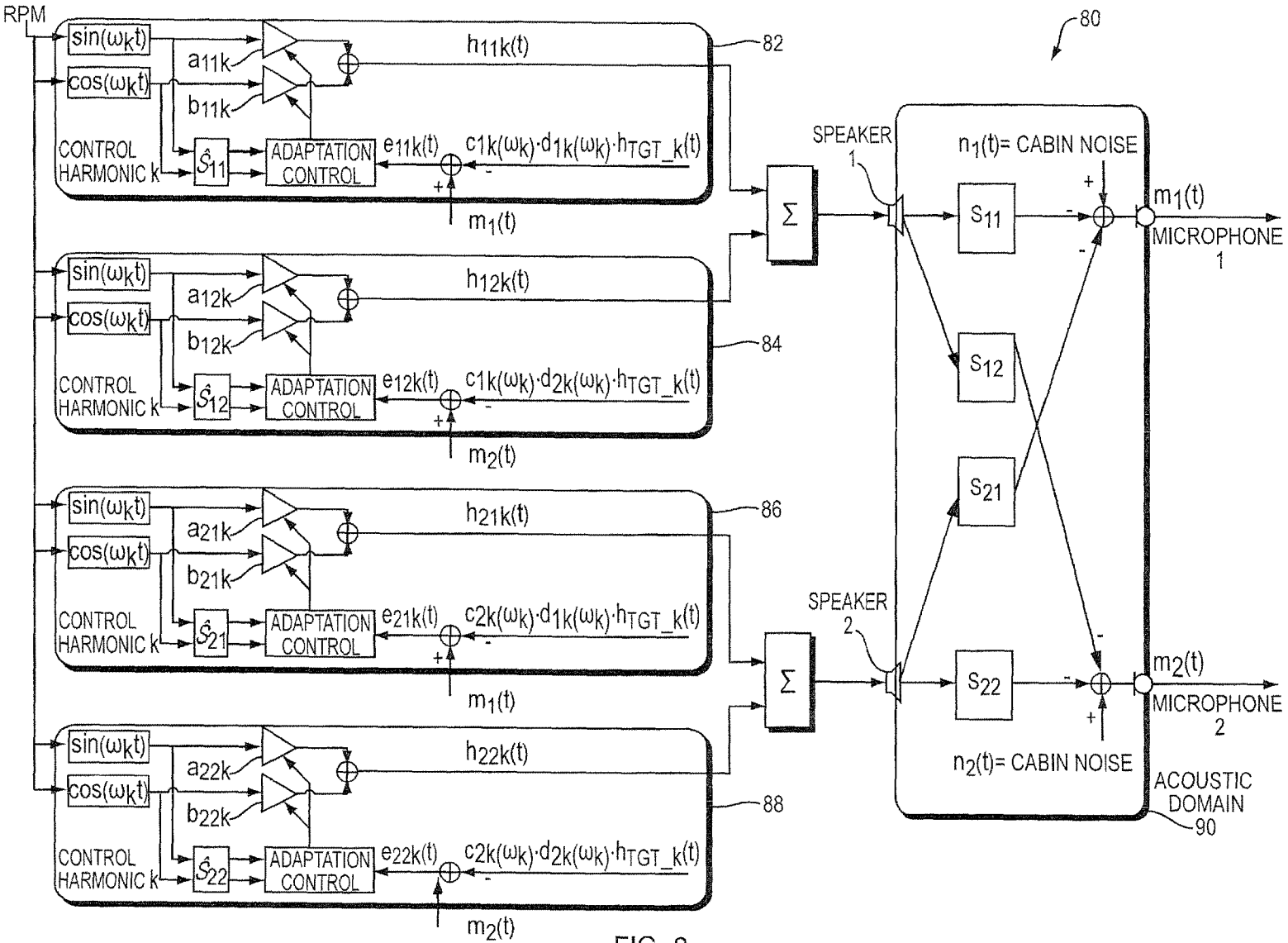

A similar approach is taken for the case of a system using multiple speakers and multiple microphones as illustrated in FIG. 8. In system 80, elements 82, 84, 86 and 88 each accomplish the functions in the electronic domain (at a single harmonic k, but for two different speakers), while element 90 accomplishes the functions in the acoustic domain and includes cabin transfer functions $S_{11}$, $S_{12}$ for speaker 1, and $S_{21}$, and $S_{22}$ for speaker 2. The coefficients $c_{1k}$, $c_{2k}$, $d_{1k}$, and $d_{2k}$ are used to select by how much each of the speakers will contribute to construct the target harmonic. The coefficients are defined as a function of RPM. This means that the system can select how much each speaker contributes at any given RPM.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. An adaptive engine harmonic sound control system for a vehicle cabin, where there is an engine harmonic sound in the vehicle cabin, the engine harmonic sound having a frequency, a magnitude, and a phase, the adaptive engine harmonic sound control system for a vehicle cabin comprising:

circuitry for generating, based on an engine operating parameter, a non-zero target engine harmonic signal representative of a target engine harmonic sound in the vehicle cabin, wherein the non-zero target engine harmonic signal comprises predefined magnitude and phase targets for each of a plurality of target harmonic signals that each have a frequency;

a microphone for measuring sound in the vehicle cabin, and having an output signal;

circuitry for combining the non-zero target engine harmonic signal and the microphone output signal to create a combined signal;

an output transducer for producing an approximation of the target engine harmonic sound at a location of the microphone; and circuitry, responsive to the combined signal, for driving the output transducer to minimize a difference between the non-zero target engine harmonic signal and the approximation of the target engine harmonic sound, by bringing the magnitude and phase of the engine harmonic sound in the vehicle cabin closer to the magnitude and phase targets of the non-zero target engine harmonic signal.

2. The adaptive engine harmonic sound control system of claim 1, wherein the circuitry for driving the output transducer comprises an adaptive filter.

3. The adaptive engine harmonic sound control system of claim 1, wherein the circuitry for generating a non-zero target engine harmonic signal comprises one or more lookup tables that map the engine operating parameter to magnitude and phase targets for the target harmonic signals.

4. The adaptive engine harmonic sound control system of claim 1 wherein at frequencies below an engine harmonic sound frequency threshold the circuitry for driving the output transducer is adapted to both enhance and cancel the engine harmonic sound in the vehicle cabin.

5. The adaptive engine harmonic sound control system of claim 1 wherein at frequencies above an engine harmonic sound frequency threshold the circuitry for driving the output transducer is adapted to enhance but not cancel the engine harmonic sound in the vehicle cabin.

6. The adaptive engine harmonic sound control system of claim 1 wherein at low engine harmonic sound frequencies the circuitry for driving the output transducer is adapted to enhance the engine harmonic sound in the vehicle cabin by driving the output transducer to generate harmonic sound that is in phase with the engine harmonic sound in the vehicle cabin.

7. The adaptive engine harmonic sound control system of claim 1 wherein at frequencies below an engine harmonic sound frequency threshold the circuitry for driving the output transducer is adapted to both enhance and cancel the engine harmonic sound in the vehicle cabin, and wherein at frequencies above an engine harmonic sound frequency threshold the circuitry for driving the output transducer is adapted to enhance but not cancel the engine harmonic sound in the vehicle cabin, and wherein at low engine harmonic sound frequencies the circuitry for driving the output transducer is adapted to enhance the engine harmonic sound in the vehicle cabin by driving the output transducer to generate harmonic sound that is in phase with the engine harmonic sound in the vehicle cabin.

8. The adaptive engine harmonic sound control system of claim 1 further comprising an engine rotation speed input.

9. The adaptive engine harmonic sound control system of claim 1 wherein the engine operating parameter comprises engine RPM.

10. The adaptive engine harmonic sound control system of claim 1 comprising multiple loudspeakers that are used to modify the level of the engine harmonic sound in the vehicle cabin, and wherein the vehicle engine harmonic modification system is arranged to select how much each speaker contributes to the engine harmonic sound in the vehicle cabin.

11. The adaptive engine harmonic sound control system of claim 3 wherein the lookup tables have table entries for the magnitude targets and the phase targets.

12. The adaptive engine harmonic sound control system of claim 11 further comprising circuitry for interpolating between lookup table entries to determine magnitude and phase targets that are not in the lookup tables.

* * * * *